US007900770B2

(12) United States Patent
Tawada et al.

(10) Patent No.: US 7,900,770 B2
(45) Date of Patent: Mar. 8, 2011

(54) CIGARETTE BOX AND BLANK SET FOR SAME

(75) Inventors: Shunsuke Tawada, Tokyo (JP); Tetsuya Nakamura, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 96 days.

(21) Appl. No.: 12/073,529

(22) Filed: Mar. 6, 2008

(65) Prior Publication Data

US 2008/0164163 A1 Jul. 10, 2008

Related U.S. Application Data

(63) Continuation of application No. PCT/JP2006/316742, filed on Aug. 25, 2006.

(30) Foreign Application Priority Data

Sep. 8, 2005 (JP) ..... 2005-260665

(51) Int. Cl.
*B65D 85/10* (2006.01)
*B65D 85/08* (2006.01)

(52) U.S. Cl. ..... 206/270; 206/250; 206/264; 206/273

(58) Field of Classification Search ..... 206/270, 206/264, 242, 249–255, 265, 268, 267, 271, 206/273, 815; 229/129.1, 87.13, 160.1
See application file for complete search history.

(56) References Cited

U.S. PATENT DOCUMENTS

| | | | | | |
|---|---|---|---|---|---|
| 439,993 | A | * | 11/1890 | Bailey | 229/121 |
| 1,953,418 | A | * | 4/1934 | MacDonald | 206/739 |
| 2,202,280 | A | | 5/1940 | Wilson | |
| 2,281,058 | A | | 4/1942 | Winterbourne | |
| 2,833,455 | A | | 5/1958 | Planas | |
| 2,929,542 | A | * | 3/1960 | O'Gorman | 206/268 |
| 3,132,790 | A | * | 5/1964 | Capuccio | 206/268 |
| 3,282,465 | A | * | 11/1966 | Davis | 221/64 |
| 3,311,283 | A | * | 3/1967 | Shimada et al. | 229/125.08 |
| 3,400,874 | A | * | 9/1968 | Shimada et al. | 206/250 |
| 3,933,299 | A | * | 1/1976 | Shimada et al. | 229/125.37 |
| 3,977,520 | A | * | 8/1976 | Grimm | 206/270 |
| 4,240,548 | A | * | 12/1980 | Stio | 206/250 |
| 4,534,463 | A | * | 8/1985 | Bouchard | 206/267 |
| 5,080,227 | A | * | 1/1992 | Focke | 206/273 |
| 2005/0103654 | A1 | * | 5/2005 | Hennessy | 206/270 |
| 2009/0205982 | A1 | * | 8/2009 | Hein et al. | 206/251 |

FOREIGN PATENT DOCUMENTS

| | | |
|---|---|---|
| EP | 0 950 618 A2 | 10/1999 |
| JP | 3-212386 A | 9/1991 |
| JP | 5-213340 A | 8/1993 |
| RU | 2242415 A | 12/2004 |

* cited by examiner

*Primary Examiner* — Steven A. Reynolds
(74) *Attorney, Agent, or Firm* — Birch, Stewart, Kolasch & Birch, LLP

(57) ABSTRACT

A cigarette box includes an inner case (2) enclosing a filter-cigarette inner pack and having an access opening (4) at the top thereof, and an outer case (8) enclosing the inner case (2) and having a push window (10) at the bottom thereof. The outer case (8) has a hinged cap (12). In a closed position, the hinged cap (12) closes the access opening (4) of the inner case (2). When the inner case (2) is pushed upward through the push window (10) to stick out of the outer case (8), the hinged cap turns around a hinge (14) from the closed position to an open position in the manner associated with the sticking-out of the inner case, thereby opening the access opening (4) of the inner case (2).

6 Claims, 11 Drawing Sheets

CIGARETTE BOX AND BLANK SET FOR SAME

This application is a Continuation of copending PCT International Application No. PCT/JP2006/316742 filed on Aug. 25, 2006, which designated the United States, and on which priority is claimed under 35 U.S.C. §120. This application also claims priority under 35 U.S.C. §119(a) on Patent Application No(s). 2005-260665 filed in Japan on Sep. 8, 2005. The entire contents of each of the above documents is hereby incorporated by reference.

TECHNICAL FIELD

This invention relates to a cigarette box and a blank set for the box, where the cigarette box is used to contain an inner pack and the inner pack includes a bundle of filter cigarettes or cigarettes and a wrapper wrapping the bundle.

BACKGROUND ART

For such cigarette boxes, so-called hinged lid packages are frequently used. As disclosed in Japanese Unexamined Patent Publication No. Hei 5-213340, for example, the package of this type has a box body and a lid for opening and closing the box body, and the inner pack is contained in the box body.

Common people including smokers have been long familiar with the above-described shape of the package. Thus, there is no freshness in the package opening and closing operation, and the package of this type is poor in such visual attraction that increases the user's buying motivation.

The primary object of the present invention is to provide a cigarette box having such novel opening and closing mode that can increase the user's buying motivation, and a black set for the box.

DISCLOSURE OF THE INVENTION

Means for Solving the Problem

In order to achieve the above object, the cigarette box according to the present invention comprises an inner case enclosing an inner pack and being partly open at the top thereof to provide an access opening at the top, and an outer case enclosing the inner case in the manner allowing the inner case to upwardly stick out, the outer case having a push window at the bottom thereof for exposing a bottom face of the inner case, and a hinged cap for opening and closing the access opening of the inner case, wherein when the inner case is pushed upward through the push window to stick out of the outer case, the hinged cap turns around a self hinge in the manner associated with the sticking-out of the inner case, thereby opening the access opening.

In the case of this cigarette box, when the user pushes up the inner case through the push window of the outer case, the inner case sticks out of the outer case. The inner case stuck out pushes the hinged cap upward, so that the hinged cap turns around the hinge. Consequently, the lid of the hinged cap moves away from the access opening of the inner case so that the access opening is opened. Thus, the user can take out a cigarette from the inner pack through the access opening and smoke the cigarette taken out.

After this, by pushing the inner case back into the outer case and turning the hinged cap reversely, the user can close the access opening of the inner case with the lid of the hinged cap.

The above-described cigarette box is greatly different in opening and closing mode compared with the common hinged lid packages, and provides a novel appearance. Thus, the cigarette box according to the present invention greatly increases the user's buying motivation.

Specifically, it can be configured such that the access opening of the inner case is disposed adjacent to one side face of the inner case, and the hinged cap includes a rear wall joined to one side wall of the outer case located on the same side as said one side face of the inner case, by means of the hinge, and when the hinged cap is in a closed position, forming an extension of the one side wall of the outer case, and a lid wall extending from the top edge of the rear wall, and when the hinged cap is in the closed position, covering the access opening of the inner case, wherein when the inner case is caused to stick out of the outer case, the inner case pushes the lid wall upward so that the hinged cap turns around the hinge, sideways of the outer case, up to an open position, thereby opening the access opening.

Desirably, the hinged cap should further include guide walls in a pair connecting opposite side edges of the lid wall with corresponding side edges of the rear wall, wherein when the hinged cap is in the closed position, one of the guide walls is held between the inner case and a front wall of the outer case and the other guide wall is held between the inner case and a rear wall of the outer case. In this case, desirably, the guide walls should have such size that ensures that the guide walls continue to be held between the inner case and the outer case when the hinged cap is caused to turn from the closed position to an open position. Such guide walls stabilize the turning, namely opening and closing of the hinged cap.

The cigarette box can further comprise a stopper for determining an amount by which the inner case sticks out of the outer case. Specifically, the stopper can include a downward-directed stop lug provided on an inner surface of the outer case, and an upward-directed engagement lug provided on an outer surface of the inner case, wherein when the inner case is caused to stick out of the outer case, the engagement lug engages with the stop lug, thereby preventing the inner case from sticking out further than intended. Desirably, the stopper should be provided between each side face of the inner case and the corresponding side wall of the outer case. Such stopper reliably prevents the inner case from coming off the outer case.

The present invention further provides a blank set for forming the cigarette box, and the blank set comprises an inner blank for forming the inner case, and an outer blank for forming the outer case. The details of the blanks will become clear from the attached drawings and description below.

BEST MODE OF CARRYING OUT THE INVENTION

Figure 1:
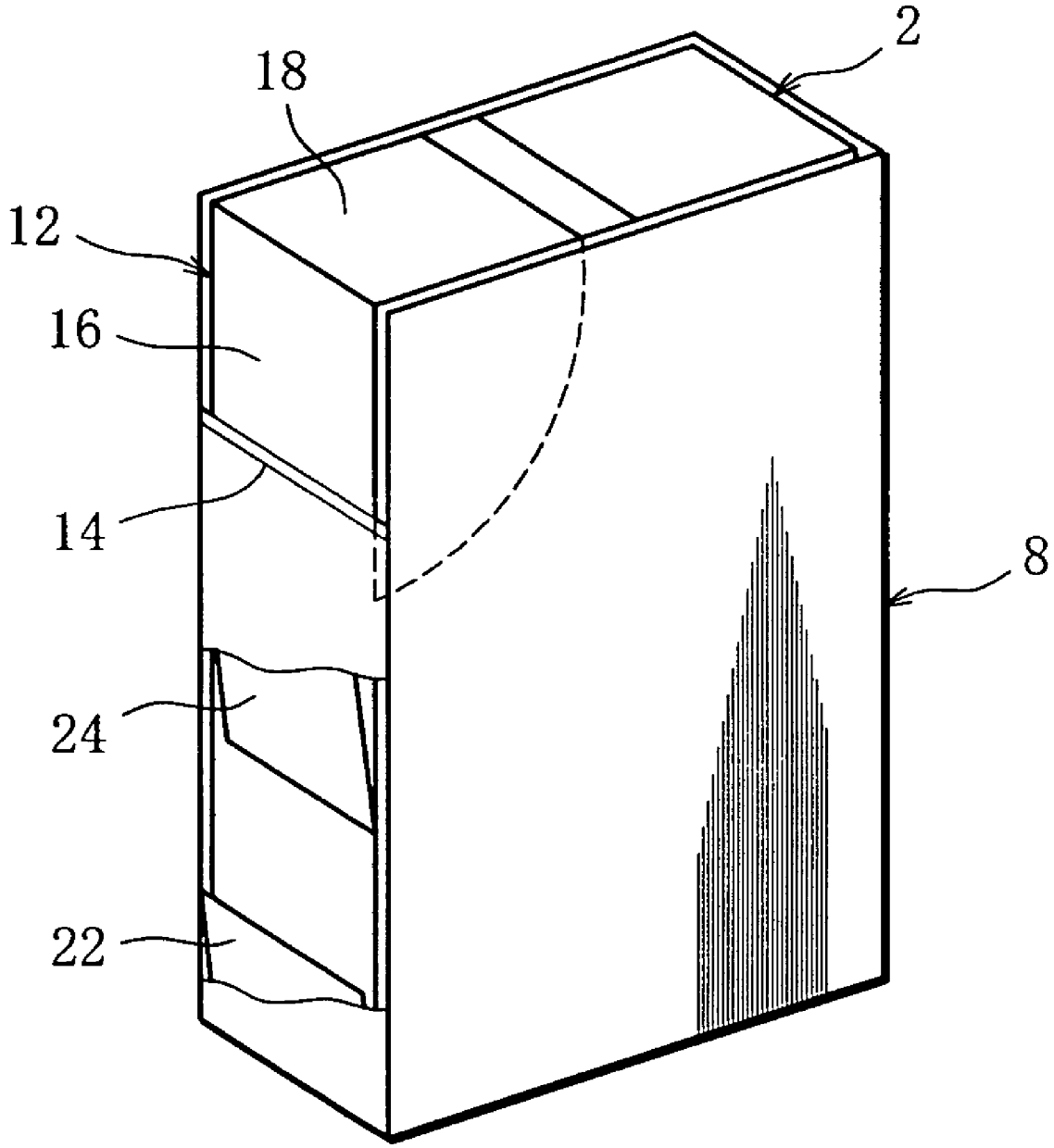
FIG. 1 A perspective view showing an embodiment of a cigarette box in a closed state.
Figure 2:
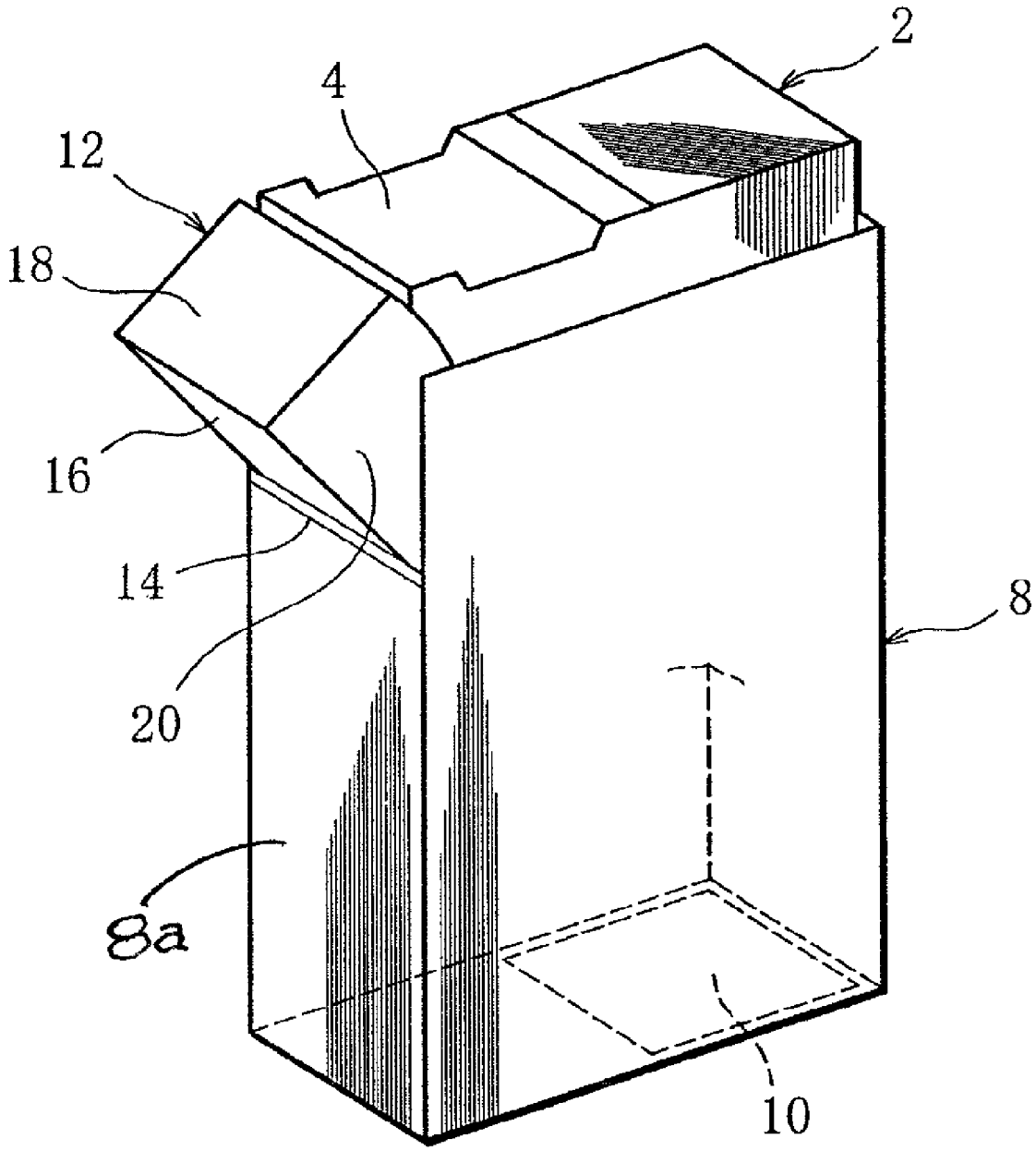
FIG. 2 A perspective view showing the cigarette box of FIG. 1 in an open state.

FIGS. 1 and 2 show an embodiment of a cigarette box.

The cigarette box includes a parallelepiped inner case 2. The inner case 2 contains an inner pack (omitted in FIGS. 1 and 2). The inner pack includes a bundle of filter cigarettes or cigarettes and a wrapper wrapping the bundle.

The inner case 2 has an access opening 4 at the top thereof, and the access opening 4 is located adjacent to one side edge of the top of the inner case 2. The inner case 2 is contained in a virtually parallelepiped outer case 8. The outer case 8 is open at the top thereof. Thus, as shown in FIG. 2, the top face of the inner case 2 is exposed in the top opening of the outer case 8.

The outer case 8 has a bottom wall, and a push window 10 is formed in the bottom wall. The push window 10 is located adjacent to a side edge of the bottom wall located on the opposite side to the access opening 4 so that the bottom wall of the inner case 2 is partly exposed.

The outer case 8 has further a hinged cap 12, and the hinged cap 12 is joined to the outer case 8 by means of a self hinge 14.

More specifically, a first side wall 8*a* of the outer case 8 located on the same side as the access opening 4 is smaller in height than a second side wall of the outer case 8 opposite to the first side wall, and the self hinge 14 connects the hinged cap 12 and the outer case 8 at the upper edge of the first side wall 8*a*. The hinged cap 12 includes a rear wall 16 extending upward from the hinge 14, and a lid 18 extending from the distal end of the rear wall 16. The total height of the rear wall 16 and first side wall 8*a* is equal to the height of the second side wall of the outer case 8. Thus, as shown in FIG. 1, when the hinged cap 12 is closed, the rear wall 16 forms an extension of the first side wall 8*a* to make up for the shortage in height of the first side wall 8*a* relative to the second side wall of the outer case 8.

The lid 18 is at right angles to the rear wall 16, and when the hinged cap 12 is in closed position as shown in FIG. 1, the lid 18 covers the access opening 4 of the inner case 2 from above, thereby closing the access opening 4. The hinged lid 18 also has guide walls 20 in a pair, and the guide walls 20 connects the side edges of the lid 18 with the corresponding side edges of the rear wall 16. When the hinged cap 12 is closed, one of the guide walls 20 is entirely and completely inserted between the front wall of the outer case 8 and the front wall of the inner case 2 while the other guide wall 20 is entirely and completely inserted between the rear wall of the outer case 8 and the rear wall of the inner case 2.

In the case of the above-described cigarette box, the user can push up the inner case 2 by pressing a finger against the bottom of the inner case 2 through the push window 10. Such pushing-up operation causes the inner case 2 to stick out of the outer case 8 upwardly.

When the inner case 2 is caused to stick out as shown in FIG. 2, the edge of the access opening 4 of the inner case 2 collides with the inner surface of the lid 18 of the hinged cap 12 and causes the hinged cap 12 to turn around the self hinge 14, from closed position to open position. As the hinged cap 12 moves sideways toward the open position in this manner, the lid 18 moves away from the access opening 4 of the inner case 2 so that the access opening 4, therefore, the cigarette box is opened. Thus, the user can take out a filter cigarette or cigarette from the inner pack contained in the inner case 2, through the access opening 4, and smoke the cigarette taken out.

Then, the user pushes the inner case 2 back into the outer case 8, and then turns the hinged cap 12 reversely from the open position to the closed position, so that the access opening 4 of the inner case 2 is closed with the lid 18 of the hinged cap 12.

As clear from FIG. 2, in spite of the hinged cap 12 movement from the closed position to the open position, the guide walls 20 in a pair of the hinged cap 12 are always held between the outer case 8 and the inner case 2, at least in part, and prevented from completely coming out from between the cases 2 and 8. Thus, when the hinged cap 12 is turned around the self hinge 14, the guide walls 20 in a pair are guided by the cases 2, 8, so that the hinged cap 12 is opened and closed smoothly and stably.

Further, as shown in FIG. 1, the inner case 2 has engagement lugs 22 on the lower portions of the opposite side walls thereof. The lugs 22 extend upward from the bottom of the inner case 2 along the corresponding side walls. Meanwhile, the outer case 8 has stop lugs 24 on the inner surfaces of the opposite side walls thereof, where the stop lugs 24 are located above the corresponding engagement lugs 22 and directed downward. Thus, when the inner case 2 is pushed upward from the outer case 8 as described above, the engagement lugs 22 collide with the corresponding stop lugs 24, so that the stop lugs 24 limit the amount by which the inner case 2 sticks out of the outer case 8. Thus, the inner case 8 is prevented from completely coming out of the outer case 8. The engagement lugs 22 and stop lugs 24 function as a stopper for preventing the inner case 2 from coming off the outer case 8.

As described above, when the present embodiment of the cigarette box is opened, the inner case 2 is caused to stick out of the outer case 8 and at the same time the hinged cap 12 turns, so that the removal opening 4 of the inner case 2 becomes exposed. Conversely, by pushing the sticking-out inner case 2 back into the outer case and turning the hinged cap 12 reversely, the cigarette box is closed. Such opening and closing mode of the cigarette box is unique compared with the common hinged lid packages, and the cigarette box provides, in its open position, an appearance clearly different from such packages. For such distinctiveness, the cigarette box according to the present invention greatly increases the user's buying motivation.

Next, a blank set for forming the cigarette box will be described. In the explanation of the blank set, FIGS. 1 and 2 are regarded as perspective views of the cigarette box viewed from the front.

Figure 3:
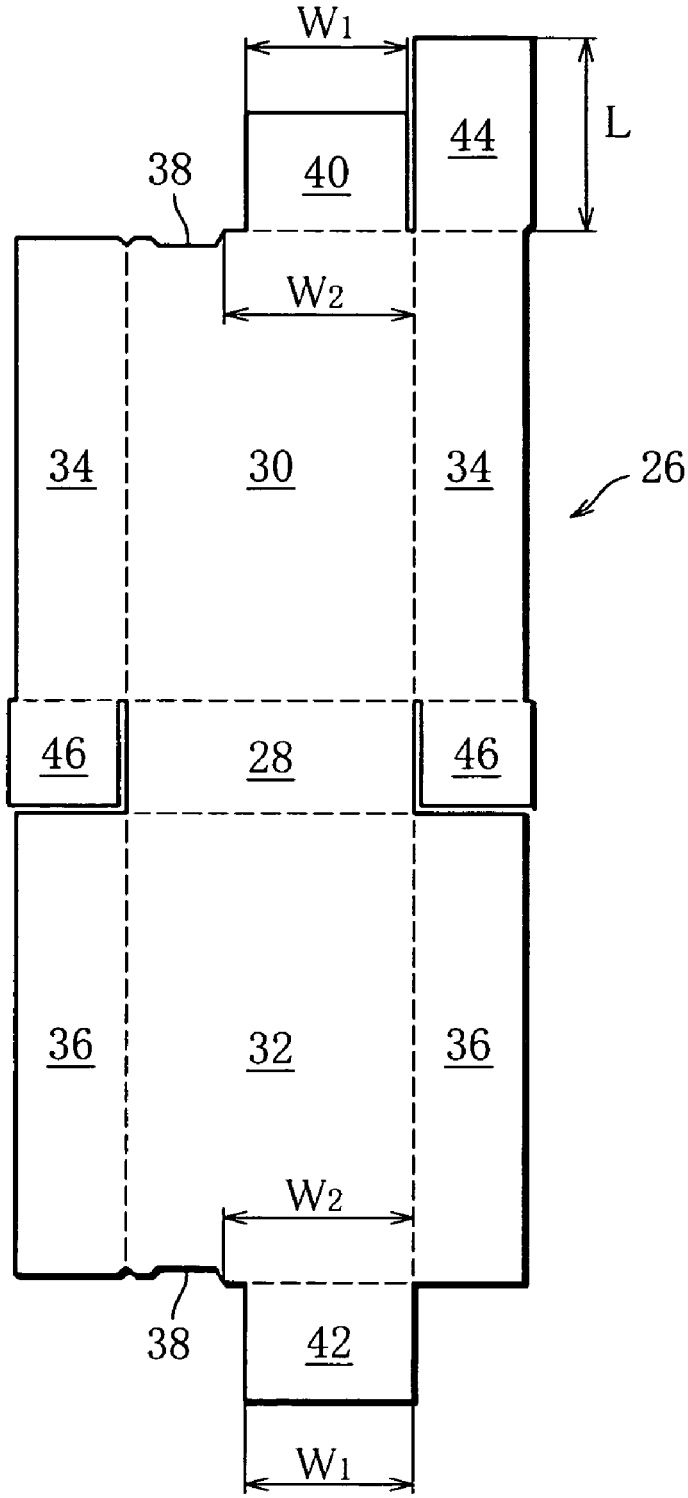
FIG. 3 A diagram showing a blank for forming an inner case of FIGS. 1 and 2.

The blank set comprises two blanks. FIG. 3 shows the inner side of a blank 26 for forming the inner case 2.

The blank 26 includes a plurality of panels and a plurality of flaps, where the adjacent panels, the adjacent flaps, and the adjacent panel and flap are demarcated by fold lines shown in broken lines.

Specifically, the blank 26 includes a rear panel 30, a bottom panel 28 and a front panel 32 arranged in a longitudinal axis of the blank 26. When viewed in FIG. 3, the bottom panel 28 is between the rear panel 30 and the front panel 32. Inner side flaps 34 are joined to the opposite side edges of the rear panel 30, while outer side flaps 36 are joined to the opposite side edges of the front panel 32.

When viewed in FIG. 3, approximately U-shaped shallow notches 38 are formed at the upper edge of the rear panel 30 and the lower edge of the front panel 32, respectively, to partly extend at the corresponding edges. The notches 38 are each disposed adjacent to the corresponding side flaps (34 or 36) which are located on the left side of the blank 26.

Further, an outer top flap 40 and an inner top flap 42 are joined to the upper edge of the rear panel 30 and the lower edge of the front panel 32, respectively, in their portions where the notches do not extend. The flaps 40, 42 are each located between the corresponding notch 38 and the right side flap (34, 36).

To the upper edge of the right inner side flap 34, an intermediate top flap 44 is joined. When L denotes the length of the intermediate top flap 44 along the longitudinal axis of the blank 26 and W1 is the width of the inner and outer flaps 40, 42 along the direction perpendicular to the longitudinal axis, the length L is greater than the width W1 and equal to the distance W2 between the right side flap 34, 36 and the notch 38.

To the lower edges of the inner side flaps 34, engagement flaps 46 are joined. The engagement flaps 46 are located on the opposite sides of the bottom panel 28.

After glue is applied to the inner side of the blank 26 at specified locations, the blank is folded over an inner pack IP according to the process shown in FIGS. 4 to 7 to form the above-described inner case 2.

Figure 4:
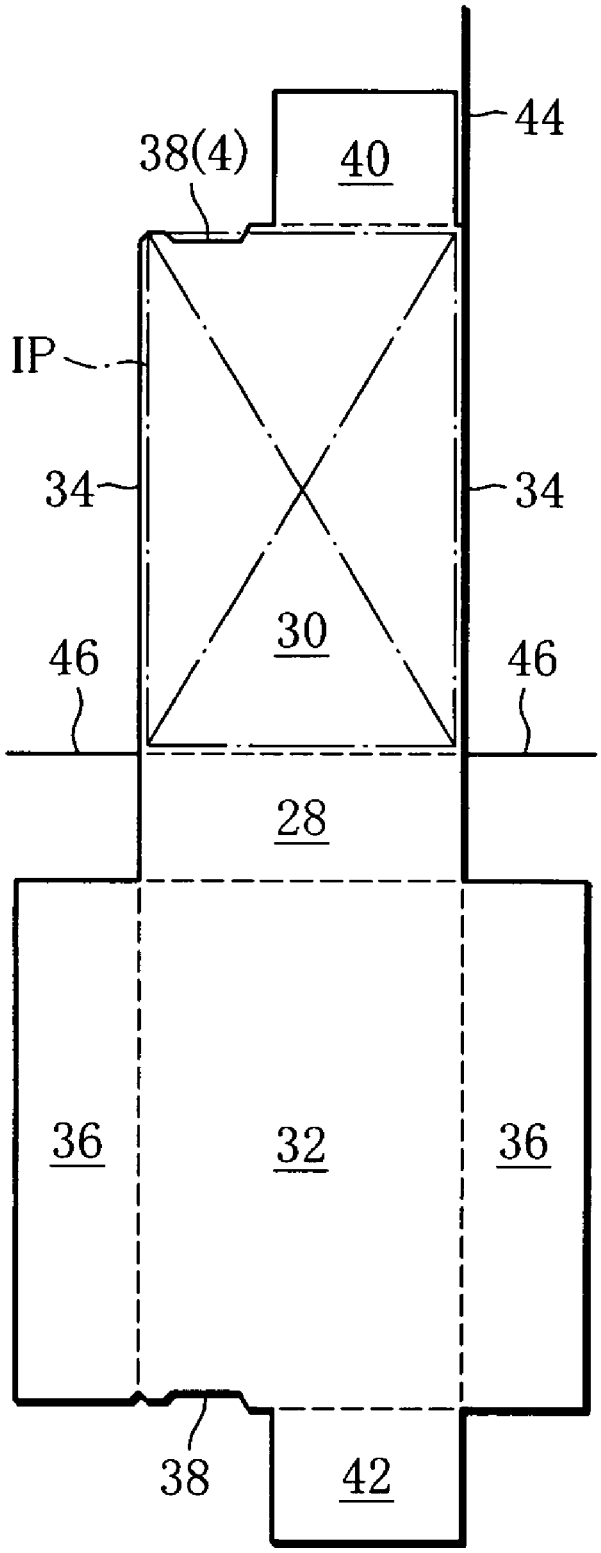
FIG. 4 A diagram showing a step of folding the blank of FIG. 3.

Specifically, first, as shown in FIG. 4, an inner pack IP is placed on the rear panel 30 so that the rear panel 30 forms the rear wall of the inner case 2. Then, the inner side flaps 34 are folded toward the corresponding side faces of the inner pack IP to be overlaid on the corresponding side faces. At this time, the engagement flaps 46 in a pair and the intermediate top flap 44 extend parallel to the side faces of the inner pack IP, together with the corresponding inner side flaps 34. From this state, the engagement flaps 46 are valley-folded, namely folded outwardly of the inner pack IP.

Figure 5:
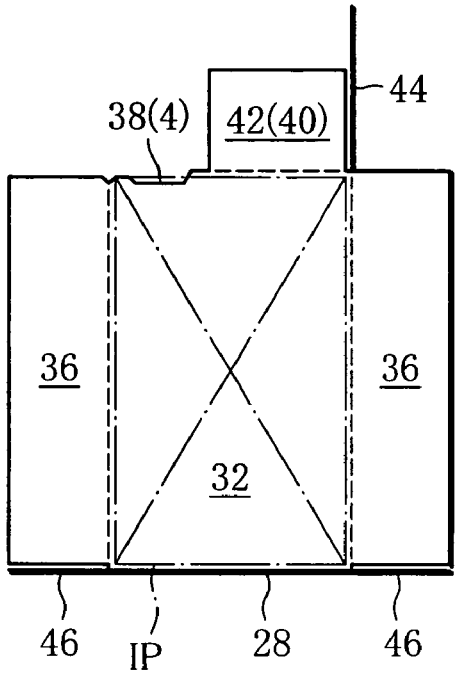
FIG. 5 A diagram showing the state after a further folding operation is performed on the blank in the state of FIG. 4.

Then, the bottom panel 28 is folded toward the bottom of the inner pack IP to be overlaid on the bottom. The bottom panel 28 forms the bottom wall of the inner case 2. The folding of the bottom panel 28 causes the front panel 32 with the outer side flaps 36 in a pair to stand relative to the inner pack IP. Then, the front panel 32 with the outer side flaps 36 in a pair is folded toward the front face of the inner pack IP to be overlaid on the front face of the inner pack IP as shown in FIG. 5. The front panel 32 forms the front wall of the inner case 2.

The folding of the front panel 32 causes the outer side flaps 36 in a pair to project outward from the corresponding side faces of the inner pack IP in the same manner as the above-mentioned engagement flaps 46, and causes the inner top flap 42 connected with the front panel 32 to face the outer top flap 44 connected with the rear panel 30 in view of the direction of the thickness of the inner pack IP.

Figure 6:
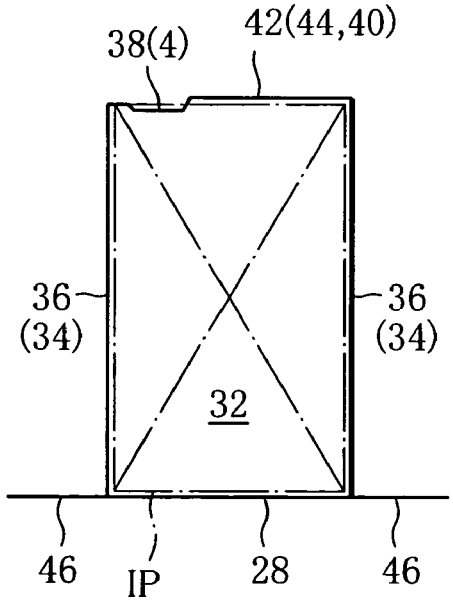
FIG. 6 A diagram showing the state after a further folding operation is performed on the blank in the state of FIG. 5.

Then, as shown in FIG. 6, the outer side flaps 36 are folded toward the corresponding side faces of the inner pack IP to be overlaid on the corresponding inner side flaps 34 already folded down, respectively. The corresponding inner and outer side flaps 34, 36 are glued together to form the side walls of the inner case 2.

At the same time as the outer side flaps 36 are folded, the inner top flap 42, the intermediate top flap 44 and the outer top flap 40 are folded toward the upper face of the inner pack IP in this order so that the flaps 42, 44, 40 are overlaid one on another. The flaps 42, 44, 40 are glued together to form a top wall of the inner case 2. The top wall partly covers the top face of the inner pack IP, so that the access opening 4 with the notches 38 is formed in a place where the top wall does not cover the top face of the inner case 2.

Figure 7:
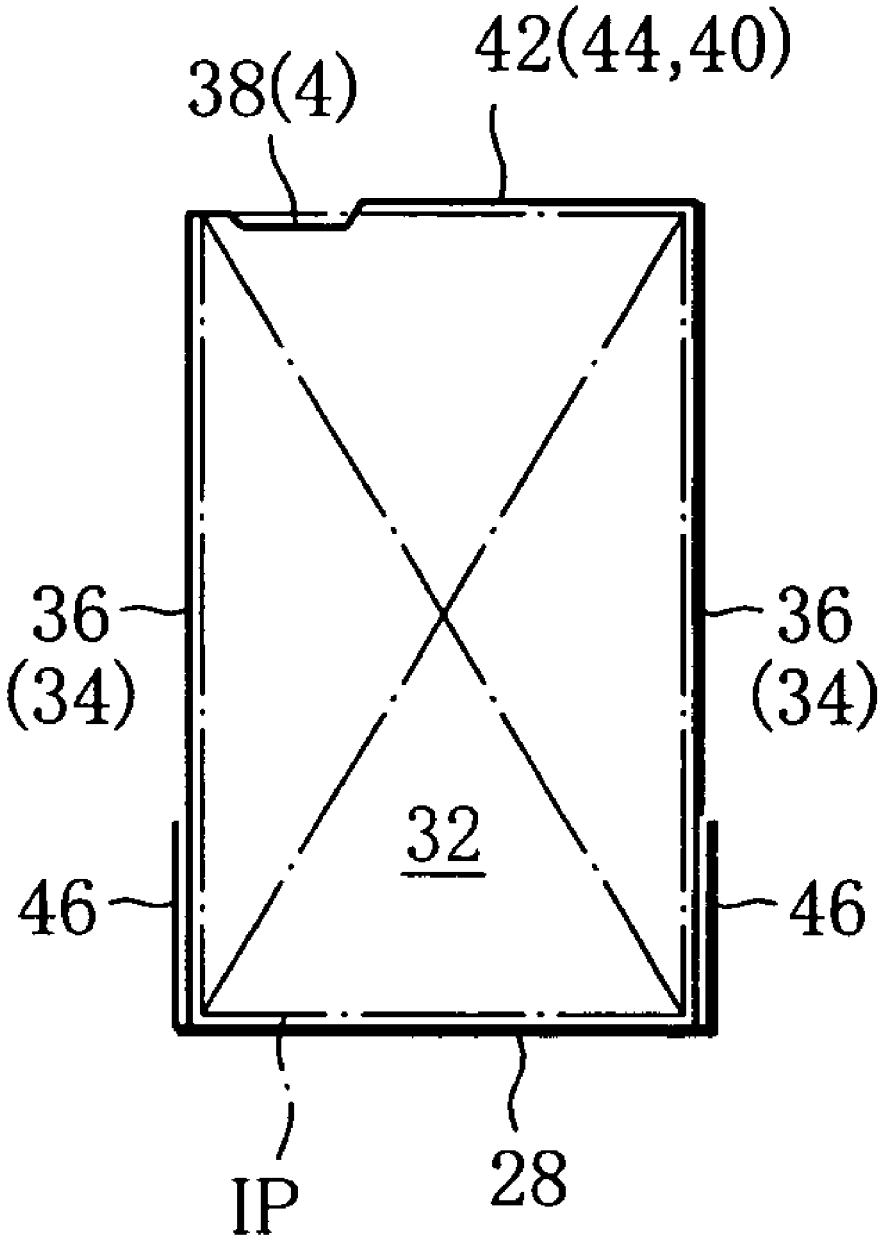
FIG. 7 A diagram showing the state after a further folding operation is performed on the blank in the state of FIG. 6.

Then, as shown in FIG. 7, the engagement flaps 46 are folded over the corresponding side walls (outer flaps 36) of the inner case 2 to form the above-mentioned engagement lugs 22.

Figure 8:
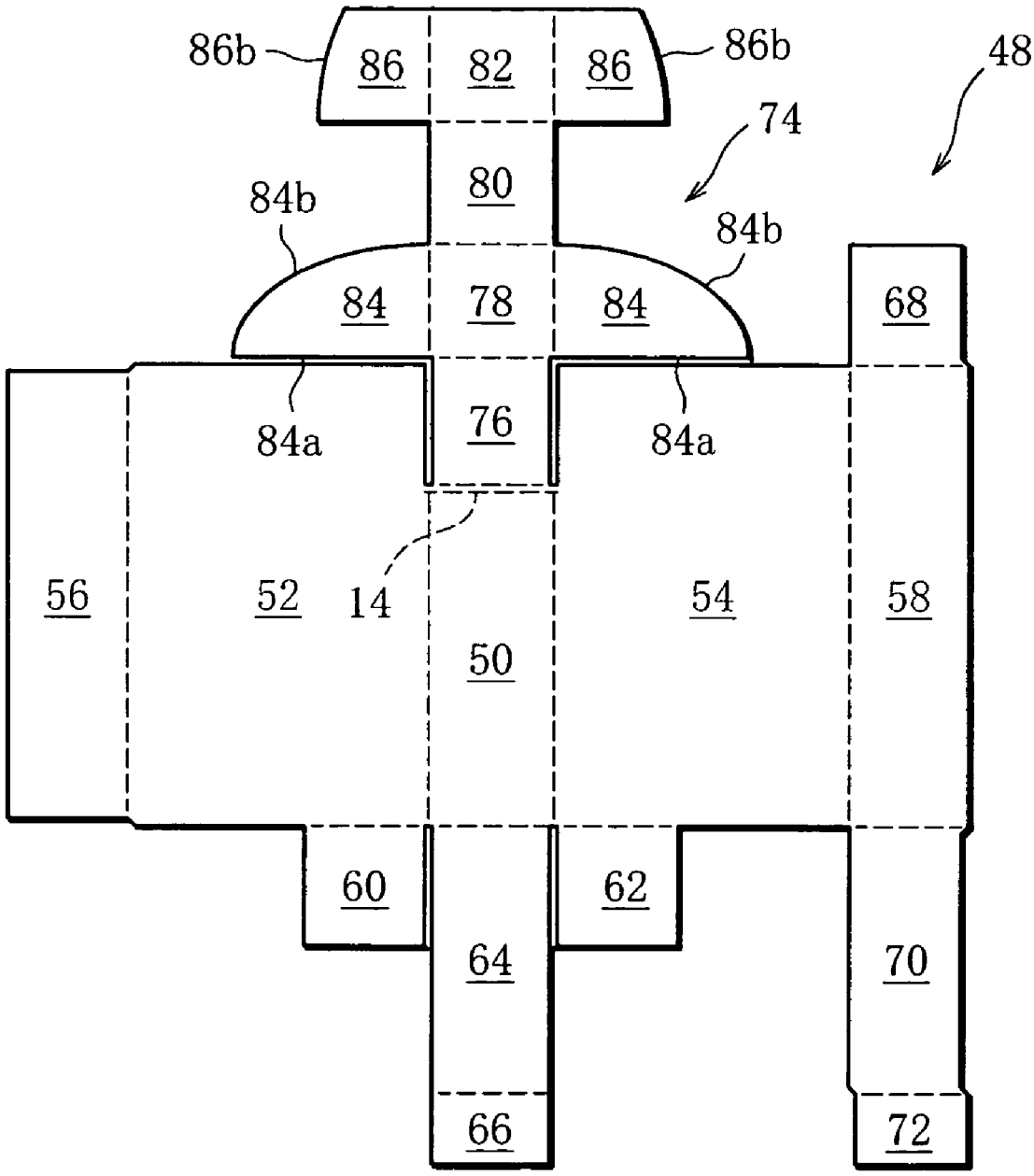
FIG. 8 A diagram showing a blank for forming an outer case of FIGS. 1 and 2.

FIG. 8 shows the inner side of a blank 48 for forming the outer case 8 with the hinged cap 12.

Also the blank 48 includes a plurality of panels and a plurality of flaps, where the adjacent panels, the adjacent flaps, and the adjacent panel and flap are demarcated by fold lines shown in broken lines.

Specifically, the blank 48 has a side panel 50 in the center. The side panel 50 forms the above-mentioned first side wall 8*a* of the outer case 8. When viewed in FIG. 8, a front panel 52 and a rear panel 54 are joined to the left and right side edges of the side panel 50, respectively. The lower edges of the panels 52, 54 are on the same line as the lower edge of the side panel 50. Meanwhile, the panels 52, 54 extend upward beyond the upper edge of the side panel 50. Thus, the panels 52, 54 are greater in length (length between the lower and upper edges) than the side panel 50.

An outer side flap 56 is joined to the side edge of the front panel 52, while an inner side flap 58 is joined to the side edge of the rear panel 54. Further, an outer bottom flap 60 and an inner bottom flap 62 are joined to the lower edges of the front panel 52 and rear panel 54, respectively. The flaps 60, 62 are disposed adjacent to the side panel 50.

To the lower edge of the side panel 50, a liner flap 64 is joined. The liner flap 64 extends between the outer bottom flap 60 and the inner bottom flap 62 and extends beyond these flaps 60, 62. To the lower edge of the liner flap 64, a stop flap 66 is joined.

Meanwhile, the inner side flap 58 has liner flaps 68, 70 joined to the upper and lower edges, respectively, and to the lower edge of the liner flap 70, a stop flap 72 is joined. The liner flap 70 is the same size as the liner flap 64, and the stop flap 72 is the same size as the stop flap 66.

To the upper edge of the side panel 50, a cap section 74 is joined. The cap section 74 is used to form the above-described hinged cap 12. Thus, the cap section 74 and the panel 50 are demarcated by a self hinge 14, not by a fold line.

The cap section 74 includes an outer rear flap 76 adjacent to the self hinge 14. The outer rear flap 76 is located between the front panel 52 and the rear panel 54, and gaps are provided between the flap 76 and the respective panels 54, 54. To the upper edge of the outer flap 76, an outer lid flap 78, an inner lid flap 80 and an inner rear flap 82 are joined in this order. The flaps 76, 78, 80, 82 are aligned in a longitudinal direction of the side panel 50.

Outer guide flaps 84 are joined to the opposite side edges of the outer lid flap 78, respectively, and inner guide flaps 86 are joined to the opposite side edges of the inner rear flap 82, respectively. As clear from FIG. 8, each outer guide flap 84 has an approximately quadrant shape with a lower edge 84*a* extending along the upper edge of the corresponding panel 52 or 54 and an arc 84*b* connecting the end of the lower edge 84*a* and the outer top flap 78. Meanwhile, each inner guide flap 86 has an arc 86*b* forming a side edge, where the arc 86*b* is designed to be congruous with the arc 84*b* of the guide flap 84.

After glue is applied to the inner side of the blank 48 at specified locations, the blank is folded over the above-described inner case 2 according to the process shown in FIGS. 6 to 16 to form the cigarette box shown in FIGS. 1 and 2, together with the inner case 2.

Figure 9:
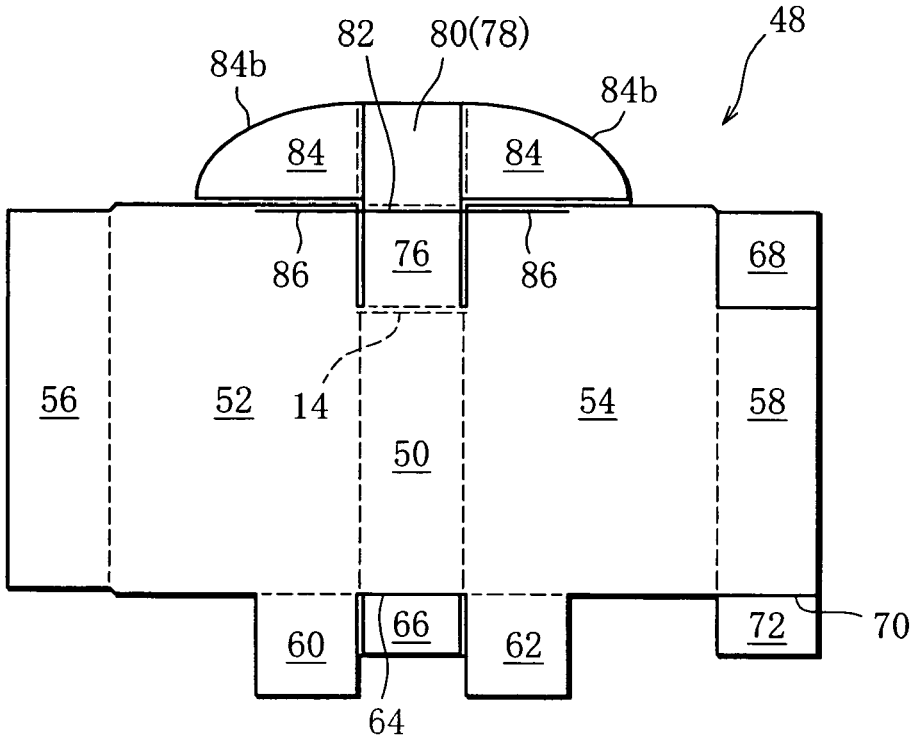
FIG. 9 A diagram showing the state after a first folding operation is performed on the blank of FIG. 8.

Specifically, first, as shown in FIG. 9, the cap section 74 is mountain-folded along the fold line between the outer lid flap 78 and the inner lid flap 80. This mountain folding causes the inner lid flap 80 to be overlaid on the outer lid flap 78. The flaps 78, 80 are glued together to form the lid 18 of the hinged cap 12.

At the same time as the inner lid flap 80 is folded, the inner rear flap 82 is valley-folded along the fold line between the inner lid flap 80 and the inner rear flap 82. This valley folding causes the inner rear flap 82 with the inner guide flaps 86 in a pair to stand relative to the formed lid 18, where, as clear from FIG. 9, the inner guide flaps 86 in a pair extend along the upper edges of the front panel 52 and the rear panel 54.

In parallel with the above-described folding of the cap section 74, the liner flap 64 is folded toward the side panel 50 so that the liner flap 64 stands relative to the side panel 50. At the same time as the liner flap 64 is folded, the stop flap 66 is valley-folded relative to the liner flap 64. This valley folding causes the stop flap 66 to project from the liner flap 64 to the same side as the inner and outer bottom flaps 60, 62, where the stop flap 66 is located above the bottom flaps 60, 62.

Meanwhile, the liner flap 70 and the stop flap 72 are folded in the same manner as the liner flap 64 and the stop flap 66, and the liner flap 68 is folded toward the inner side flap 58 to be overlaid on the inner side flap 58.

Figure 10:
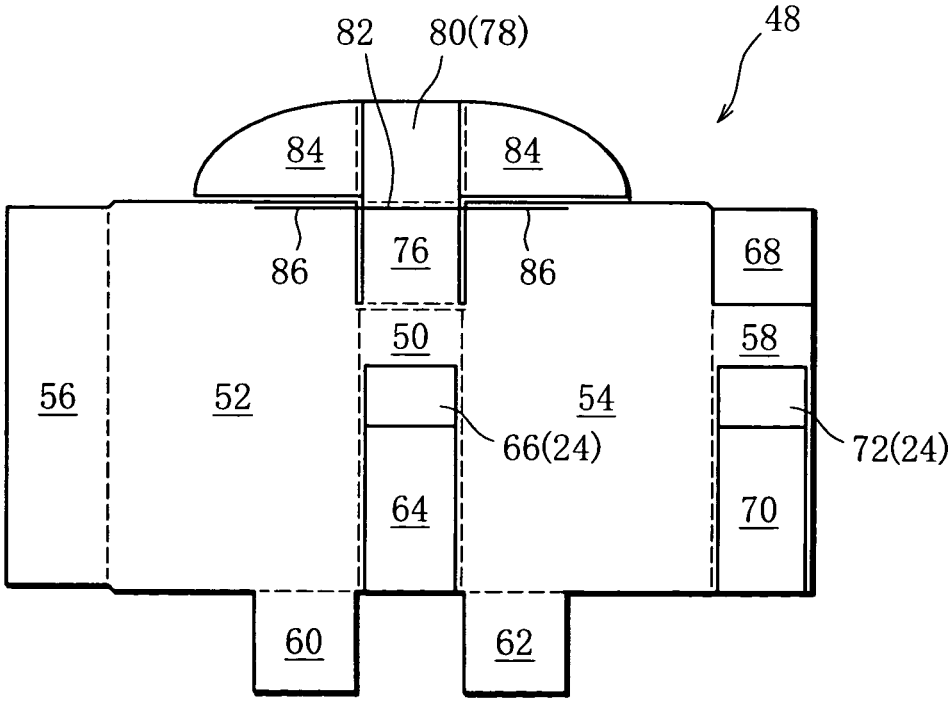
FIG. 10 A diagram showing the state after a further folding operation is performed on the blank in the state of FIG. 9.

Next, as shown in FIG. 10, the liner flaps 64, 70 are further folded toward the side panel 50 and the inner side flap 58 to be overlaid on the side panel 50 and the inner side flap 58, respectively. Then, the stop flaps 66, 72 are further valley-folded to be overlaid on the liner flaps 64, 70, respectively. These stop flaps 66, 72 form the above-described stop lugs 24 (see FIG. 1).

Figure 11:
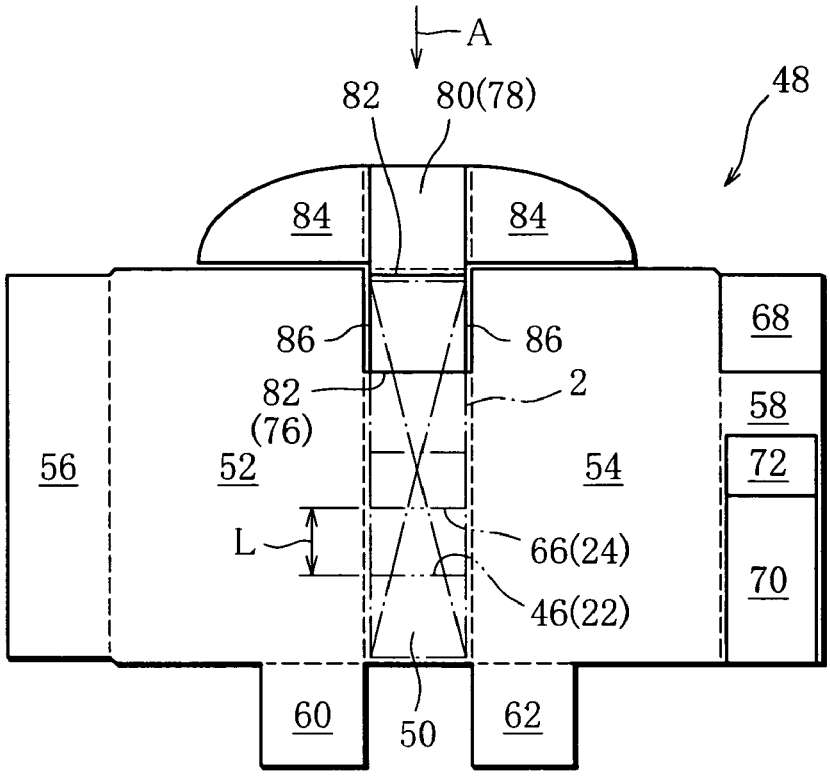
FIG. 11 A diagram showing the state after an inner case is supplied onto the blank in the state of FIG. 10 and the inner case causes further folding of the blank.

Then, the inner case 2 is caused to advance toward the side panel 50 along the direction of the arrow A in FIG. 11. The inner case 2 advances with its bottom taking the lead and with its first side face adjacent to the access opening 4 down. This advance of the inner case 2 folds the standing inner rear flap 82 toward the outer rear flap 76 so that the inner rear flap 82 is overlaid one the outer rear flap 76. The flaps 82, 76 are glued together to form the rear wall 16 of the hinged cap 12.

This folding of the inner rear flap 82 causes the left and right inner guide flaps 86 to turn toward the course of advance of the inner case 2 through 90°, so that the turned inner guide flaps 86 hold the inner case 2 between them.

The advance of the inner case 2 is continued until the bottom of the inner case 2 reaches the lower edge of the side panel 50. When the advance of the inner case 2 is completed, the side wall of the inner case 2 adjacent to the access opening covers the inner rear flap 82 and the side panel 50, entirely. Thus, the stop flap 66 forming the stop lug 24 and the liner flap 64 are held between the side panel 50 and the first side face of the inner case 2.

In this state, as shown in FIG. 11, the stop flap 66 (stop lug 24) is a specified distance D apart from the engagement flap 46 (engagement lug 22) of the inner case 2, the longitudinal direction of the side panel 50. This distance D determines the amount by which the inner case 2 is allowed to stick out of the outer case 8.

In the above-described advance of the inner case 2, the engagement flap 46, i.e., the engagement lug 22 of the inner case 2 is directed in the opposite direction to the advance of the inner case 2, while the stop flap 66, i.e., the stop lug 24 of the blank 48 is directed in the same direction as the advance of the inner case 2. Thus, during the advance of the inner case 2, the engagement lug 22 of the inner case 2 smoothly moves beyond the stop lug 24, without engaging with the stop lug 24, which ensures the provision of the above-mentioned distance D.

Figure 12:
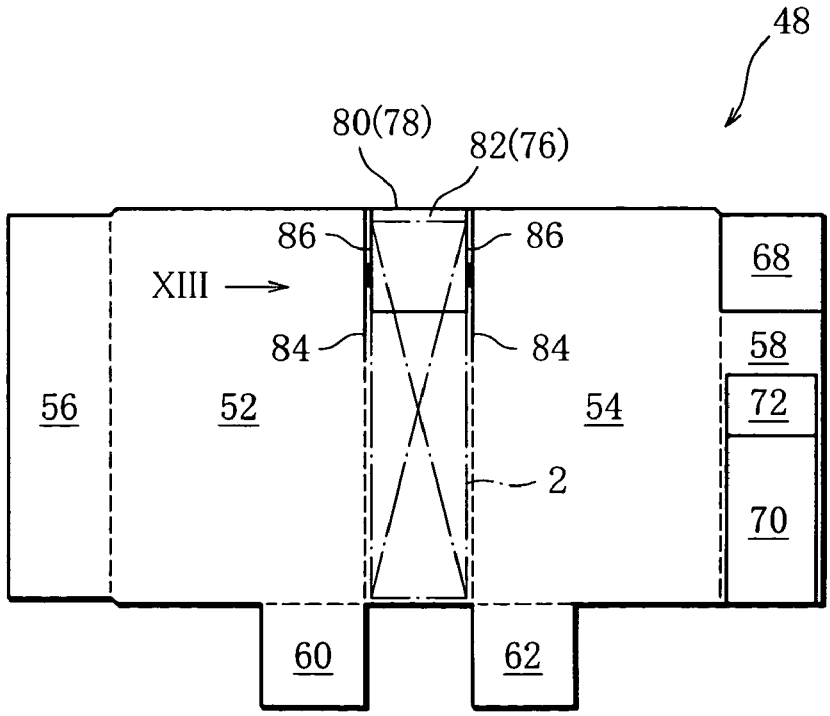
FIG. 12 A diagram showing the state after a further folding operation is performed on the blank in the state of FIG. 11.
Figure 13:
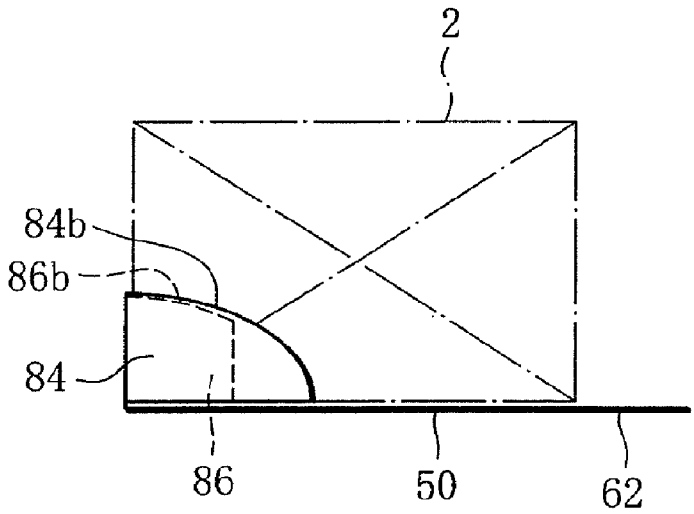
FIG. 13 A diagram showing the blank viewed from direction XIII as indicated by an arrow in FIG. 12.

Next, with the left and right outer guide flaps 84, the outer lid flap 78 and the inner lid flap 80 glued together are folded toward the top of the inner case 2 to partly cover the top of the inner case 2, or in other word, cover the access opening 4 of the inner case 2 as shown in FIG. 12, thereby closing the access opening 4. Then, the left and right outer guide flaps 84 are folded toward the inner guide flaps 86 already folded down to be overlaid on the inner guide flaps 86, respectively. The corresponding guide flaps 84, 86 are glued together to form the guide walls 20 of the hinged cap 12. It is to be noted that in the guide flaps 84, 86 laid one on the other, the arcs 84*b*, 86*b* are congruous with each other as shown in FIG. 13.

Figure 14:
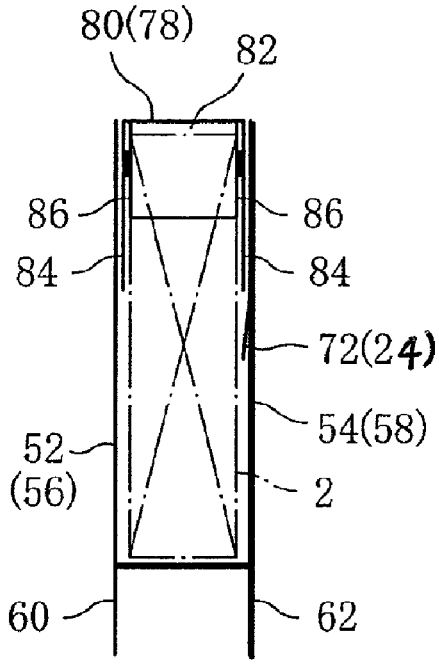
FIG. 14 A diagram showing the state after a further folding operation is performed on the blank in the state of FIG. 12.

Next, as shown in FIG. 14, the front panel 52 and the rear panel 54 are folded toward the front face and the rear face of the inner case 2 to be overlaid on the front face and the rear face, respectively. The front panel 52 and the rear panel 54 form the front wall and the rear wall of the outer case 8, where the guide walls (guide flaps 84, 86) of the hinged cap 12 are each held between the corresponding panel 52 or 54 and the inner case 2.

Figure 15:
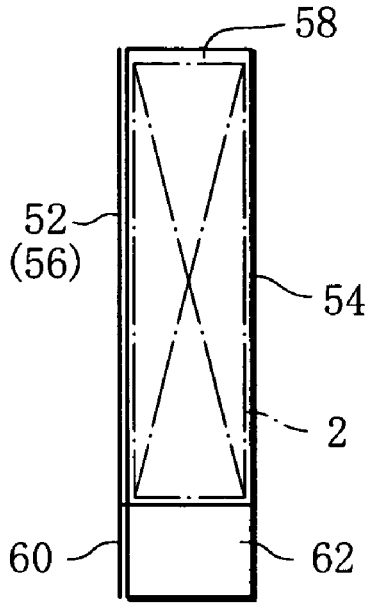
FIG. 15 A diagram showing the state after a further folding operation is performed on the blank in the state of FIG. 14.

Then, as shown in FIG. 15, the inner side flap 58 connected with the rear panel 54 is folded toward the other side wall of the inner case 2 remote from the removal opening to be overlaid on the other side wall. Consequently, the liner flaps 68, 70 connected with the inner side flap 58 and the stop flap 72 (stop lug 24) are held between the inner case 2 and the inner side flap 58. Needless to say, also on the other side face of the inner case 2, the distance D is provided between the engagement lug 22 of the inner case 2 and the stop lug 24.

Figure 16:
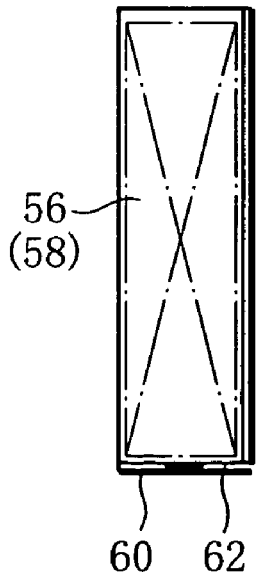
FIG. 16 A diagram showing the state after a further folding operation is performed on the blank in the state of FIG. 15.

Then, as shown in FIG. 16, the inner bottom flap 62 connected with the inner side flap 58 and the outer bottom flap 60 connected with the outer bottom flap 56 are folded toward the bottom face of the inner case 2, successively, so that the outer bottom flap is overlaid on the inner bottom flap on the bottom face. The outer and inner bottom flaps 60, 62 are glued together to form a bottom wall of the outer case 8 that partly covers the bottom face of the inner case 2, thereby providing the above-mentioned push window 10.

Then, the outer side flap 56 connected with the front panel 52 is folded toward the inner side flap 58 already folded down to be overlaid on the flap 58. The flaps 56, 58 are glued together to form the other side wall of the outer case 8. At this time, the cigarette box shown in FIG. 1 is completed.

The present invention is not limited to the above-described embodiment of the cigarette box and blank set for it. For example, the engagement lug 22 and stop lug 24 for limiting the sticking-out of the inner case 2 can be replaced with a stopper of another form.

The invention claimed is:

1. A cigarette box for containing an inner pack, the inner pack including a bundle of cigarettes and a wrapper wrapping the bundle, comprising:

an inner case enclosing the inner pack and being partly open at a top thereof to provide an access opening at the top, and an outer case enclosing said inner case in the manner allowing said inner case to upwardly stick out, said outer case having a push window at a bottom thereof for exposing a bottom face of said inner case, and a hinged cap for opening and closing the access opening of said inner case, wherein when said inner case is pushed upward through the push window to stick out of said outer case, the hinged cap turns around a self hinge in the manner associated with the sticking-out of said inner case, thereby opening the access opening, wherein the access opening and the push window are arranged to be remote from each other in a width direction of said outer case so that the access opening and the push window are adjacent to a different one of opposing side walls of the outer case, and said hinge connects said hinged cap with side wall of the outer case wherein the access opening is disposed adjacent to one side face of said inner case, and the hinged cap includes a rear wall joined to one side wall of said outer case located on the same side as said one side face of said inner case, by means of the hinge, and when the hinged cap is in a closed position, forming an extension of said one side wall of said outer case, and a lid wall extending from a top edge of the rear wall, and when the hinged cap is in the closed position, covering the access opening of said inner case, wherein when said inner case is caused to stick out of said outer case, said inner case pushes the lid wall upward so that the hinged cap turns around the hinge, sideways of said outer case, up to an open position, thereby opening the access opening, and wherein the hinged cap further includes guide walls in a pair connecting opposite side edges of the lid wall with the corresponding side edges of the rear wall, wherein when the hinged cap is in the closed position, one of the guide walls is held between said inner case and a front wall of said outer case and the other guide wall is held between said inner case and a rear wall of said outer case.

2. The cigarette box according to claim 1, wherein the guides walls have such size that ensures that the guide walls continue to be held between said inner case and said outer case when the hinged cap is caused to turn from the closed position to the open position.

3. The cigarette box according to claim 1, further comprising a stopper for determining an amount by which said inner case sticks out of said outer case.

4. The cigarette box according to claim 3, wherein said stopper includes a downward-directed stop lug provided on an inner surface of said outer case, and an upward-directed engagement lug provided on an outer surface of said inner case, wherein when said inner case is caused to stick out of said outer case, the engagement lug engages with the stop lug, thereby preventing said inner case from sticking out further than intended.

5. The cigarette box according to claim 4, wherein said stopper is provided between each side face of said inner case and the corresponding side wall of said outer case.

6. A blank set for forming the cigarette box according to claim 5, comprising:

an inner blank for forming said inner case, and an outer blank for forming said outer case, said inner blank including:

a longitudinal axis, a rear panel, a bottom panel and a front panel arranged along the longitudinal axis, where the adjacent panels are demarcated by a fold line, the rear panel, the bottom panel and the front panel being designed to form a rear wall, a bottom and a front wall of said inner case, inner side flaps in a pair jointed to opposite side edges of the rear panel across fold lines, respectively, outer side flaps in a pair jointed to opposite side edges of the front panel across fold lines, the outer side flaps being designed to form opposite side walls of said inner case in cooperation with the inner side flaps, top flaps in a pair joined to end edges of the rear panel and the front panel across fold lines, respectively, the top flaps being designed to form, in cooperation, the top of said inner case provided with the access opening, and engagement flaps in a pair disposed on opposite sides of the bottom panel and joined to the inner side flaps across fold lines, respectively, the engagement flaps being designed to form the engagement lugs of said inner case, said outer blank including:

a rear panel, a side panel and a front panel arranged laterally, adjacent to one another, where the adjacent panels are demarcated by a fold line, the rear panel, the side panel and the front panel being designed to form a rear wall, one side wall and a front wall of said outer case, an inner side flap joined to a side edge of the front panel across a fold line, an outer side flap joined to a side edge of the rear panel across a fold line, the outer side flap being designed to form the other side wall of said outer case in cooperation with the inner side flap, a cap section joined to one end edge of the side panel by means of said hinge, the cap section including an outer rear flap, an outer lid flap, an inner lid flap and an inner rear flap aligned with each other from the side panel in a longitudinal direction of the side panel, where adjacent flaps are demarcated by a fold line, the outer and inner rear flaps being designed to form a rear wall of the hinged cap and the outer and inner lid flaps being designed to form a lid wall of the hinged cap, inner guide flaps in a pair joined to opposite side edges of the inner rear flap across fold lines, respectively, and outer guide flaps in a pair joined to opposite side edges of the outer lid flap across fold lines, respectively, the outer guide flaps being designed to form guide walls of the hinged cap in cooperation with the inner guide flaps, bottom flaps in a pair joined to end edges of the rear panel and the front panel located on the other end edges of the side panel across fold lines, respectively, the bottom flaps being designed to form, in cooperation, the bottom of said outer case provided with said push window, liner flaps in a pair joined to the other end edge of the side panel and an end edge of the inner side flap located on the same side as the other end edge of the side panel across fold lines, respectively, the liner flaps being designed to form liners on opposite side walls of said outer case, and stop flaps in a pair joined to respective distal ends of the liner flaps across fold lines, respectively, the stop flaps being designed to form the stop lugs of said outer case.

* * * * *